US011735337B2

(12) United States Patent
Lee

(10) Patent No.: US 11,735,337 B2
(45) Date of Patent: Aug. 22, 2023

(54) USB TRANSMISSION CABLE STRUCTURE

(71) Applicant: James Cheng Lee, La Habra, CA (US)

(72) Inventor: James Cheng Lee, La Habra, CA (US)

( * ) Notice: Subject to any disclaimer, the term of this patent is extended or adjusted under 35 U.S.C. 154(b) by 0 days.

(21) Appl. No.: 17/575,226

(22) Filed: Jan. 13, 2022

(65) Prior Publication Data

US 2023/0162891 A1 May 25, 2023

Related U.S. Application Data

(60) Provisional application No. 63/282,201, filed on Nov. 23, 2021.

(30) Foreign Application Priority Data

Jan. 7, 2022 (CN) ..... 202220032382.6

(51) Int. Cl.
*H01B 11/02* (2006.01)
*H01B 11/00* (2006.01)

(52) U.S. Cl.
CPC ..... *H01B 11/002* (2013.01)

(58) Field of Classification Search
CPC ..... H01B 3/30; H01B 7/02; H01B 7/0283; H01B 7/06; H01B 7/08; H01B 7/30; H01B 11/02; H01B 11/002; H01B 11/203; H01B 11/04; H01B 11/06; H01B 11/08; H01B 11/10; H01B 11/1033; H01B 11/1895; H01B 11/1091; H01B 11/18; H01B 11/20
USPC ..... 174/102 R, 103, 106 R, 108, 109, 174/110 R–110 N, 113 R, 113 C, 117 R, 174/117 F
See application file for complete search history.

(56) References Cited

U.S. PATENT DOCUMENTS 6,403,887 B1 * 6/2002 Kebabjian ..... H01B 11/1025 174/113 R
6,765,150 B2 * 7/2004 Hsieh ..... H01B 7/0861 174/117 FF
7,956,290 B2 * 6/2011 Wang ..... H01B 11/00 174/117 F
9,697,926 B2 * 7/2017 Huang ..... H01B 7/0823
10,147,523 B2 * 12/2018 Rengert ..... H01B 11/1091
2011/0280527 A1 * 11/2011 Tamura ..... G02B 6/4433 385/101
2012/0111602 A1 * 5/2012 Wei ..... H01B 7/0861 174/114 R (Continued)

FOREIGN PATENT DOCUMENTS

JP 2264717 A2 * 12/2010 ..... H01B 7/08
JP 2011-243318 A * 12/2011 ..... H01B 11/22

*Primary Examiner* — William H. Mayo, III
(74) *Attorney, Agent, or Firm* — Lin & Associates Intellectual Property, Inc.

(57) ABSTRACT

A USB cable structure includes a cable body and a plurality of wires. The cable body extends a length along an axial direction and forms an inner space, and the inner space forms an elliptical cross-section in the radial section of the cable body perpendicular to the axial direction. The plurality of wires are arranged in the elliptical inner space of the cable body, and the diameter of the wire can be increased by the enlarged elliptical inner space to reduce the attenuation of the transmission signal, thereby extending the length of the transmission cable to transmit the signal to a longer distance without the assistance of the attenuation compensation chip.

9 Claims, 5 Drawing Sheets

(56) References Cited

U.S. PATENT DOCUMENTS

| | | | | |
|---|---|---|---|---|
| 2013/0175081 | A1* | 7/2013 | Watanabe | H01B 11/1834 174/363 |
| 2013/0180752 | A1* | 7/2013 | Kodama | H01B 11/1882 174/107 |
| 2015/0096785 | A1* | 4/2015 | Hayash | H01B 11/20 174/113 R |
| 2015/0200040 | A1* | 7/2015 | Pon | H01B 11/00 174/103 |
| 2015/0293314 | A1* | 10/2015 | Byczkiewicz | H01B 11/20 385/100 |
| 2016/0020002 | A1* | 1/2016 | Feng | H01B 11/20 174/103 |
| 2017/0025203 | A1* | 1/2017 | Chen | H01B 11/20 |
| 2017/0025204 | A1* | 1/2017 | Chapman | C09D 127/18 |
| 2017/0110221 | A1* | 4/2017 | Wu | H01B 11/20 |
| 2017/0345530 | A1* | 11/2017 | Koeppendoerfer | H01B 11/20 |
| 2018/0061525 | A1* | 3/2018 | Kohori | H01B 3/447 |

* cited by examiner

USB TRANSMISSION CABLE STRUCTURE

BACKGROUND OF THE INVENTION

1. Field of the Invention

The present invention relates generally to a universal serial bus (USB) transmission cable structure.

2. The Prior Arts

Universal Serial Bus (USB) is a serial port bus standard for connecting computer systems and external devices, and also a technical specification for input and output interfaces. USB has been widely used in information communication products, such as, personal computers and mobile devices, and other related fields.

The latest generation of USB is USB 4, and the new generation of physical connectors is USB Type-C.

Compared with the earlier USB Type-A and USB Type-B, the USB Type-C connector is characterized by being able to be plugged into the interface in both orientations, and is thinner and smaller in size, which is beneficial for diversifying 3C product designs in pursuit of thinness and lightweight under the trend of sophisticated consumer market.

USB 4 is the latest version of transmission specification, which provides the advantages of transmitting data at a higher speed, smart power management, longer life, and more durable. Therefore, combining the USB Type-C connector with the USB 4 transmission specification is a future trend.

Based on the requirements of the USB Type-C specification and USB 4 transmission specification, the transmission cable connecting the USB Type-C connector needs to be equipped with more kinds of wires than in the previous versions, such as: high-frequency wire, low-frequency wire, main power wire (VBUS), ground wire (GND), differential signal data wire (D+, D−), cable controller power supply wire (Vconn), auxiliary signal wire (SUB), positive and negative plug detection signal wires (CC), and so on. However, in the USB 4 specification, since the radial cross-section shape of the transmission cable of the existing specification is circular, and the space is small, it will not be possible to arrange the aforementioned multiple existing linear specifications in the circular space while further reducing the signal attenuation (the attenuation value is inversely proportional to the diameter of the wire), so that the length of the signal wire cannot be extended. Therefore, the USB cable cannot be extended to more physical applications that require long-distance transmission of signals. When long-distance transmission is required, attenuation compensation chips must be added, which increases the cost of the product.

FIG. 1 shows the state of disposed wires in a conventional USB transmission cable with a circular radial cross-section. The wires include: high-frequency wire A, main power wire (VBUS) B, ground wire (GND) C, differential signal data wire (D+, D−) D, cable controller power supply wire (Vconn) E, auxiliary signal wire (SUB) F, and positive and negative plug detection signal wire (CC) G. Since the thickness of the wire will affect the electrical characteristics, it can be understood that if a variety of wires are packed in a relatively small circular space, the diameter of the wire inevitably cannot be enlarged, so that the signal attenuation during signal transmission cannot be reduced. The transmission cable cannot be designed to be long (the effective transmission distance of the conventional USB 4 20 GHZ transmission cable is only 0.8 m~1 m), and when long-distance transmission is required, an attenuation compensation chip is also required.

SUMMARY OF THE INVENTION

A primary objective of the present invention is to provide a way to expand the inner space of the cable body of the USB transmission cable, so that the inner space can be larger than the space of the radial cross-section of the conventional transmission cable to be configured with various wires. Under the premise of signal matching, the cable body can be extended to transmit electronic data and data for a longer distance.

To achieve the foregoing objective, the present invention provides a USB transmission cable structure, including: a cable body extending a length along an axial direction and forming an inner space, and the inner space forming an elliptical cross-section in the radial direction of the cable body perpendicular to the axial direction; and a plurality of wires, arranged in the inner space of the cable body. In the present invention, by forming the inner space of the cable body into an elliptic shape, the inner space can be enlarged, so that the diameter of the wire disposed in the inner space can be maximized, so as to reduce the attenuation of the transmission signal per unit length of the wire, and then the transmission cable can be designed to be longer to expand to more physical applications that require long-distance signal transmission without the need for an attenuation compensation chip.

Preferably, the ratio of the major axis to the minor axis of the elliptic cross-section is in the range of 1.4:1 to 1.5:1, so as to comply with the specifications of related electronic and electrical equipment.

In an embodiment, the outer periphery of the cable body may be formed into an ellipse with the same shape as the inner periphery of the inner space; or the outer periphery of the cable body may be formed differently from the inner periphery of the inner space, such as rectangle or ellipse with different shapes.

In an embodiment, the inner space of the cable body forms a first quadrant, a second quadrant, a third quadrant, and a fourth quadrant with the major axis and the minor axis of the ellipse, and the plurality of wires comprise: a first high-frequency wire group arranged in the first quadrant and contacting the cable body; a second high-frequency wire group arranged in the second quadrant and contacting the cable body; a third high-frequency wire group arranged in the third quadrant and in contact with the cable body; and a fourth high-frequency wire group arranged in the fourth quadrant and in contact with the cable body.

In an embodiment, each of the high-frequency wire groups comprises: two conductive wires, each having a conductor and an insulating layer covering the conductor, the conductive wires being arranged in contact with each other by the insulating layer; a ground wire and a filler, respectively arranged on two opposite sides of the contact between the conductive wires and are in contact with the insulating layers; and an insulating tape, covering the outer surfaces of the conductive wires and the outer sides of the ground wire and the filler. The insulating tape comprises an inner layer and an outer layer, wherein the ground wire and the filler fill up the space formed between the conductive wires and the inner layer of the insulating tape to support and position the conductive wires to prevent the high-frequency wire group from deformation.

In an embodiment, the wires comprise three main power wires, and the main power wires are arranged within a space surrounded by the first to fourth high-frequency wire groups along the elliptical major axis of the inner space.

In an embodiment, the wires comprise: a first ground wire disposed in the space between the first high-frequency wire group, the fourth high-frequency wire group and the cable body; and a second ground wire, arranged in the space between the second high-frequency wire group, the third high-frequency wire group and the cable body; a third ground wire, arranged adjacent to the main power wires and located in the first quadrant; and a fourth ground wire, arranged adjacent to the main power wires and located in the second quadrant.

In an embodiment, the wires comprise: differential signal data wires, arranged adjacent to the third ground wire and the fourth ground wire, and located in the space between the first high-frequency wire group and the second high-frequency wire group.

In an embodiment, the wires comprise: a plurality of low-frequency wires, arranged adjacent to the main power wires, and in the space between the third high-frequency wire group and the fourth high-frequency wire group.

In an embodiment, the space surrounded by the differential signal data wire, the first high-frequency wire group, the second high-frequency wire group, and the cable body is provided with a first support; and the space surrounded by the low-frequency wires, the third high-frequency wire group, the fourth high-frequency wire group, and the cable body is provided with a second support, wherein the first support and the second support are for supporting and positioning the wire so that the radial section of the cable body maintains a complete ellipse.

Preferably, the first support and the second support may be made of polyethylene (PE), thermoplastic elastomer (TPE), or polytetrafluoroethylene (PTFE).

BRIEF DESCRIPTION OF THE DRAWINGS

The present invention will be apparent to those skilled in the art by reading the following detailed description of a preferred embodiment thereof, with reference to the attached drawings, in which:

FIG. 1 is a schematic view showing the wire arrangement state of a conventional USB transmission cable in a circular inner space;

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
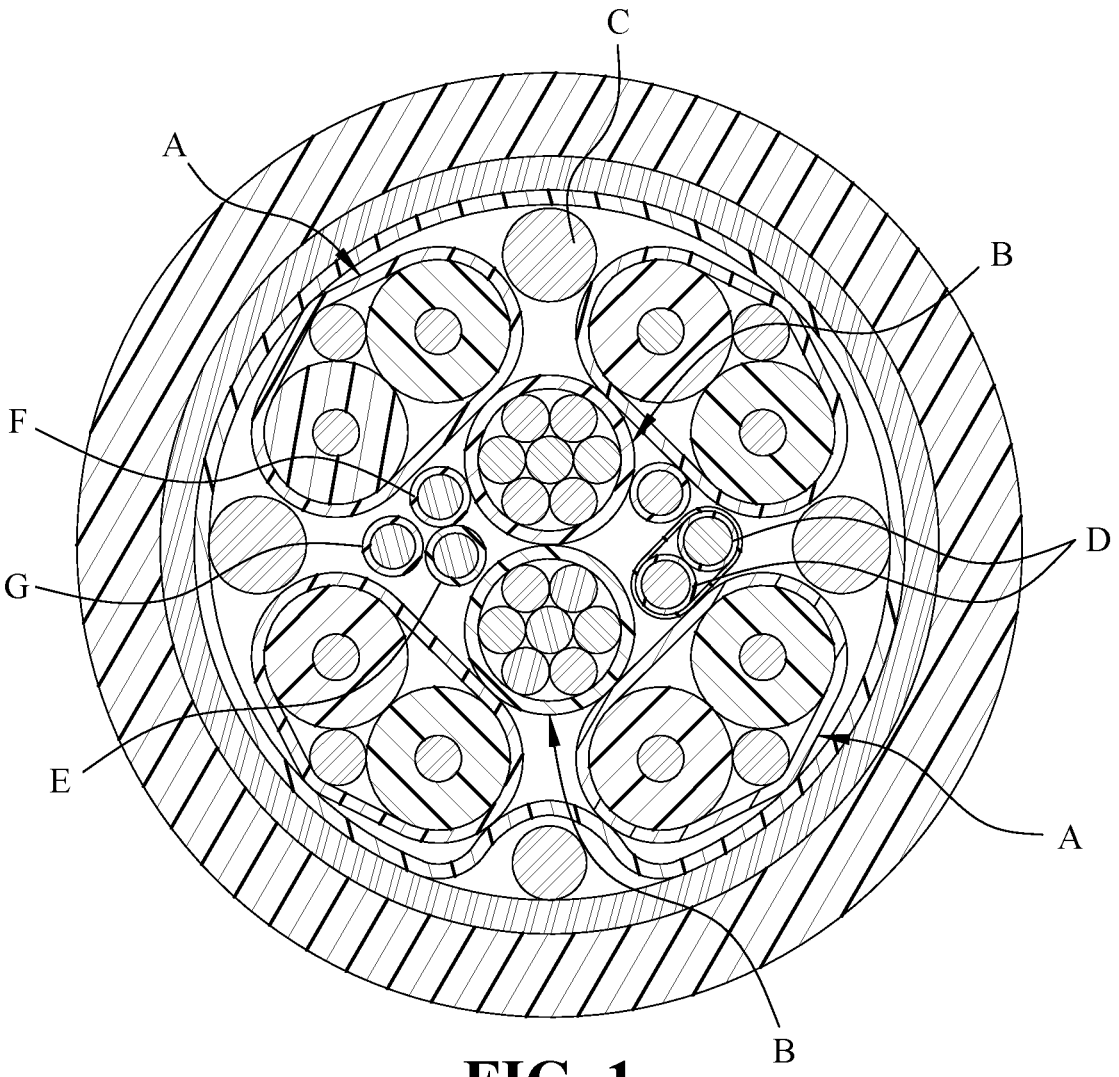
FIG. 1 (PRIOR ART)
FIG. 1 is a schematic diagram illustrating a correlation between components of a direction control apparatus according to an embodiment of the present invention.
Figure 2:
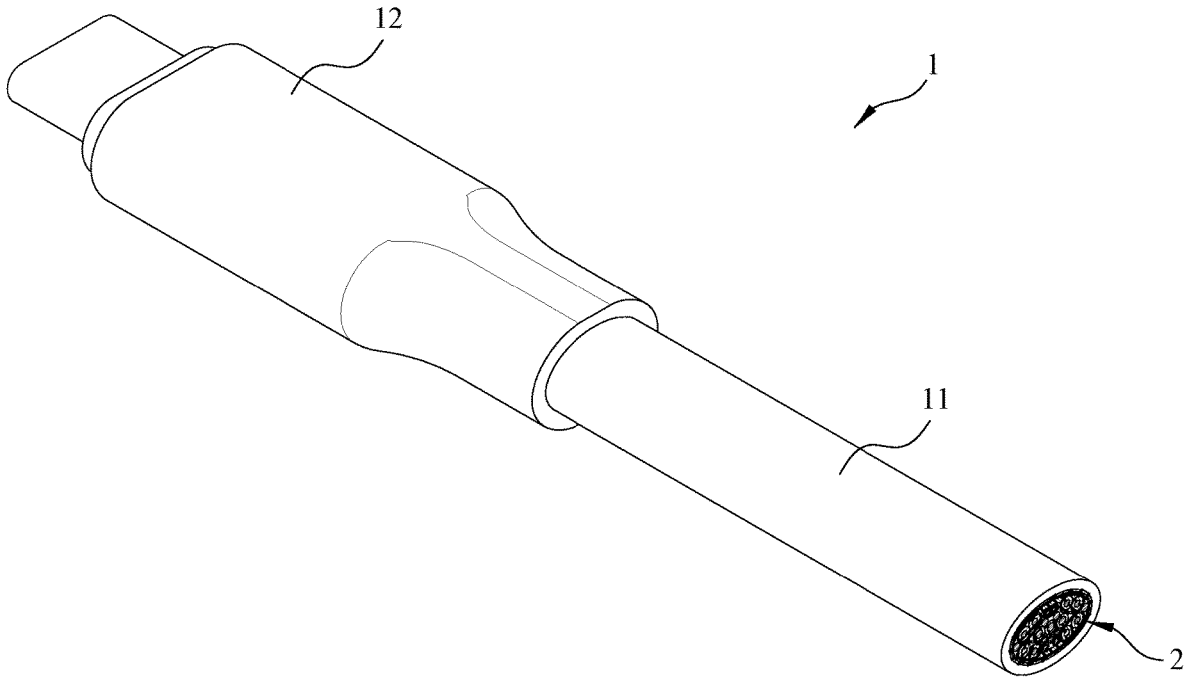
FIG. 2 is a three-dimensional schematic view showing the appearance of the USB transmission cable of the present invention.
Figure 3:
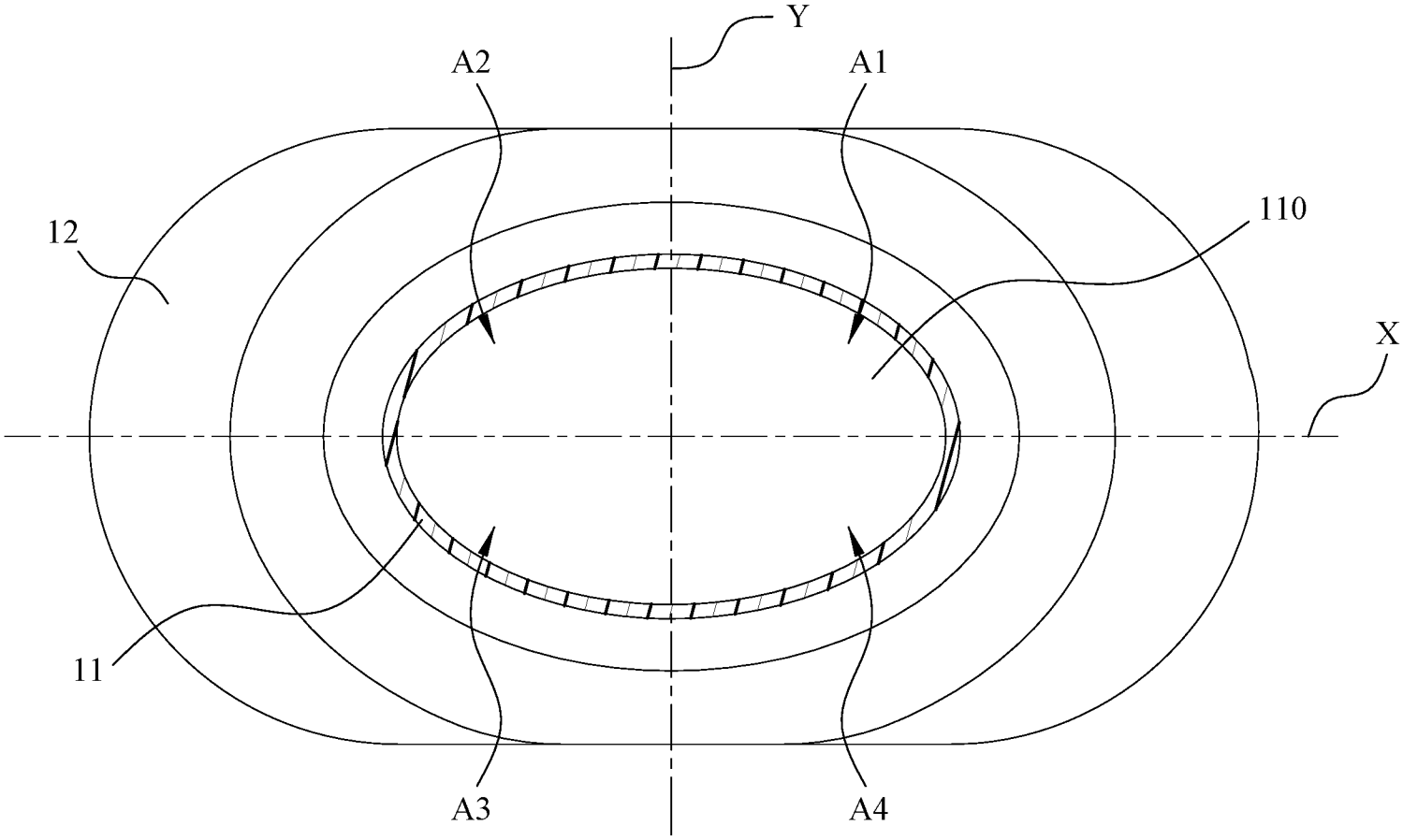
FIG. 3 is a schematic view showing that the USB transmission cable of the present invention divides the radially elliptical inner space into four quadrants with the major axis and the minor axis.
Figure 5:
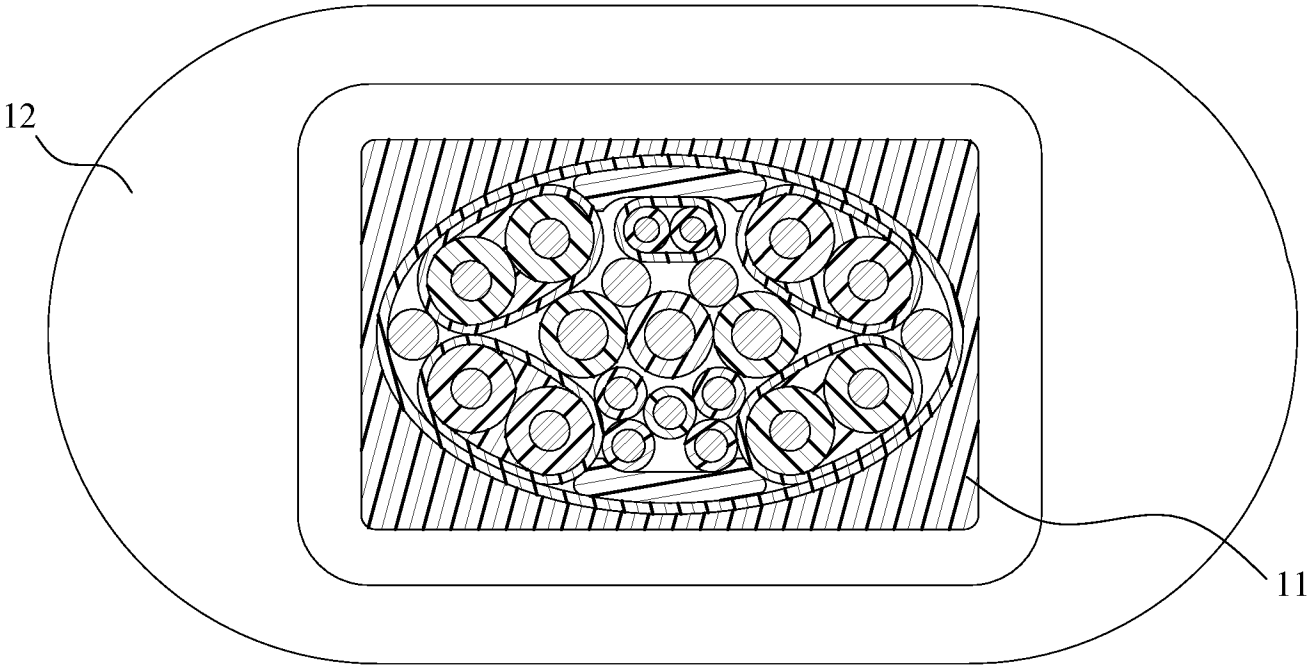
FIG. 5 is a schematic planar view showing an embodiment of the USB transmission cable of the present invention in which the outer periphery of the cable body is formed into a rectangle.

As shown in FIGS. 2 and 3, the USB transmission cable 1 provided by the present invention includes: a cable body 11, a connector 12 connected to an end of the cable body 11, and a variety of wires 2 arranged in a space 110 formed inside the cable body 11. Wherein, as shown in FIG. 3, the cable body 11 is formed to extend a length along an axial direction and an elliptical inner space 110 is formed. More specifically, the inner space 110 forms an elliptical cross-section at the radical plane perpendicular to the axial direction of the cable body 11; furthermore, in an actual embodiment, the outer circumference of the cable body 11 may be formed as an ellipse with the same shape as the inner circumference of the inner space 110, or depending on appearance design requirement, the outer periphery of the cable body 11 can be formed into a shape different from the inner periphery of the inner space 110, such as a rectangle (as shown in FIG. 5) or an ellipse with a different shape, which means an ellipse with different ratio of the length of the major axis X to the minor axis Y. Preferably, in the embodiment of the present invention, the ratio of the major axis X to the minor axis Y of the ellipse is in the range of 1.4:1 to 1.5:1 to meet the specifications of related electrical and electronic equipment. Preferably, the length of the major axis X is 7.35 mm, and the length of the minor axis Y is 4.95 mm.

In order to facilitate the description of the configuration of the wires 2 inside the elliptical inner space 110 of the cable body 11, FIG. 3 shows a schematic view of dividing the inner space 110 into a first quadrant A1, a second quadrant A2, a third quadrant A3, and a fourth quadrant A4 by the virtual major X axis and the minor Y axis of the elliptic inner space 110.

The number and types of the various wires 2 arranged in the inner space 110 within the cable body 11 are determined according to the transmission function to be achieved by the transmission cable 1, such as charging, data transmission, . . . and other functions. The following is an example of the present invention based on the USB 4 transmission specification and the Type-C connector specification.

Figure 4:
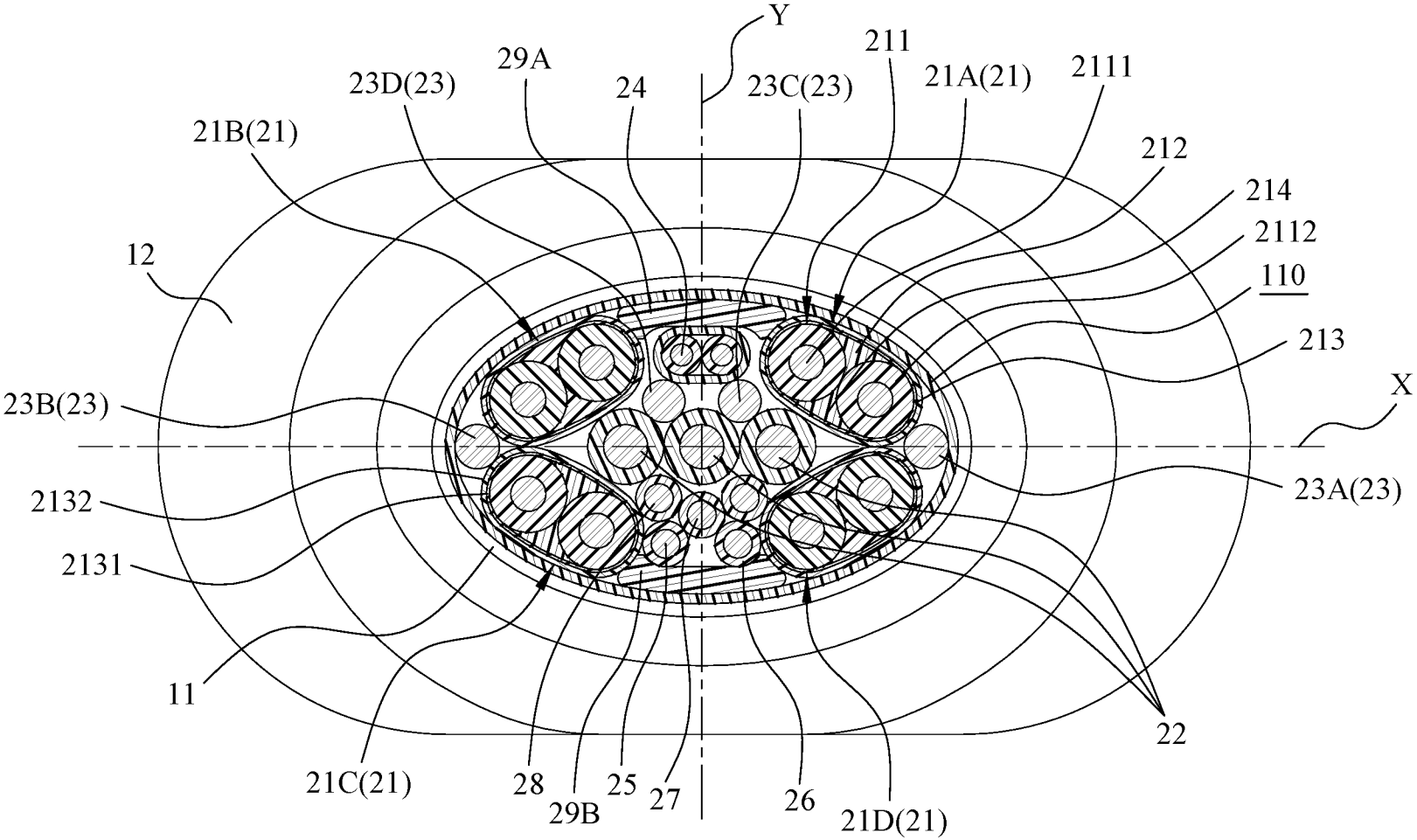
FIG. 4 is a schematic view showing the wire arrangement state of the USB transmission cable of the present invention in the elliptical inner space.

As shown in FIG. 4, in the Type-C connector specification transmission cable with the USB 4 transmission specification, the wire 2 configured in the inner space 110 within the cable body 11 may include: a plurality of high-frequency wire groups 21, a plurality of total power supply wires 22 (VBUS), a plurality of ground wires 23 (GND), two differential signal data wires 24 (D+, D−), one cable controller power supply wire 25 (Vconn), a plurality of auxiliary signal wires 26 (SUB), and a positive and negative plug detection signal wire 27 (CC) and so on.

Wherein, in the embodiment of the present invention, there are four high-frequency wire groups 21, which are the first high-frequency wire group 21A, the second high-frequency wire group 21B, the third high-frequency wire group 21C, and the fourth high-frequency wire group 21D; wherein the first high-frequency wire group 21A is arranged in the aforementioned first quadrant A1 and contacts the wall surface of the inner space 110 within the cable body 11, and the second high-frequency wire group 21B is arranged in the aforementioned second quadrant A2 and contacts the wall surface of the inner space 110 of the cable body 11, the third high-frequency wire group 21C is arranged in the aforementioned third quadrant A3 and contacts the wall surface of the inner space 110 of the cable body 11, and the fourth high-frequency wire group 21D is arranged in the aforementioned fourth quadrant A4 and contacts the wall surface of the inner space 110 of the cable body 11.

The present invention is based on two conductive wires 211 forming each of the high-frequency wire groups 21 for transmitting high-frequency signals; specifically, each high-frequency wire group 21 includes: two conductive wires 211, a ground wire 212, a filler 214, and an insulating tape 213; wherein, each conductive wire 211 has a conductor 2111 and an insulating layer 2112 covering the conductor 2111, the two conductive wires 211 are arranged side by side and the insulating layers 2112 are in contact with each other; the ground wire 212 is arranged on one side of the contact between the two conductive wires 211 and is in contact with the insulating layer 2112, and the filler 214 is arranged on the other side of the contact between the two conductive wires 211 and opposite to the ground wire 212. The insulating tape 213 is used to cover the conductive wires 211, the ground wire 212 and the filler 214; wherein, the insulating tape 213 also includes an inner layer 2131 and an outer layer 2132. The inner layer 2131 may be a metal mesh tape, The outer layer 2132 is an insulating material combined on the outside of the metal mesh belt; the insulating tape 213 is used to cover the two conductive wires 211, the ground wire 212 and the filler 214; that is, by means of the structure of the inner layer 2131 and the outer layer 2132, the insulating tape 213 protects the two conductive wires 211, the ground wire 212 and the filler 214, and shields the external interference on the high frequency signal transmission of the conductor 2111. Furthermore, in the preferred embodiment of the present invention, the radial cross-sections of the ground wire 212 and the filler 214 are respectively formed to match the shape of the spaces of the side and the other side between the inner surface of the insulating tape 213 and the conductive wires 211 so that the ground wire 212 and the filler 214 are covered by the insulating tape 213 and then fill the space formed between the conductive wires 211 and the inner layer 2131 of the insulating tape 213 so as to support and position the conductive wires 211 to prevent the high-frequency wire group 21 from deformation.

In the preferred embodiment of the present invention, the wires 2 may include three main power wires 22 (VBUS). With the elliptic inner space 110 of the cable body 11, the main power wires 22 can be disposed in a space surrounded by the first to fourth high-frequency wire groups 21A-21D along the major axis X of the ellipse.

In the preferred embodiment of the present invention, the wires 2 may include four ground wires 23, which are a first ground wire 23A, a second ground wire 23B, a third ground wire 23C, and a fourth ground wire 23D, respectively. In the elliptical inner space 110 of the cable body 11, the first ground wire 23A is arranged in the space surrounded by the first high-frequency wire group 21A, the fourth high-frequency wire group 21D and the inner surface of the cable body 11; the second ground wire 23B is arranged in the space surrounded by the second high-frequency wire group 21B, the third high-frequency wire group 21C and the inner surface of the cable body 11; the third ground wire 23C is arranged adjacent to the main power wires 22 and located in the first quadrant A1; the fourth ground 23D is arranged adjacent to the main power wire 22 and located in the second quadrant A2. As shown in FIG. 4, both the third ground wire 23C and the fourth ground wire 23D are arranged immediately adjacent to the main power wire 22.

In the preferred embodiment of the present invention, the wires 2 may include a differential signal data wire 24, and the differential signal data wire 24 is arranged adjacent to the third ground wire 23C and the fourth ground wire 23D, and is located in the space between the first high-frequency wire group 21A and the second high-frequency wire group 21B.

In the preferred embodiment of the present invention, the wires 2 may include a plurality of low-frequency wires 28, which are arranged adjacent to the main power wire 22, and located in the space between the third high-frequency wire group 21C and the fourth high-frequency wire group 21D.

In the preferred embodiment of the present invention, the space between the differential signal data line 24, the first high-frequency wire group 21A, the second high-frequency wire group 21B, and the cable body 11 can be provided with a first support 29A; the space between the low-frequency wires 28, the third high-frequency wire group 21C, the fourth high-frequency wire group 21D, and the cable body 11 can be provided with a second support 29B. Through the support and positioning effect of the first support 29A and the second support 29B on the wires 2, the radial cross-section of the cable body 11 can maintain a complete ellipse and avoids deforming. The first support 29A and the second support 29B can be made of polyethylene (PE), thermoplastic elastomer (TPE) or polytetrafluoroethylene (PTFE).

By forming the inner space 110 of the cable body 11 into an ellipse, the present invention can expand the inner space to accommodate more wires with larger wire diameters, so that under the premise of the signal's matching, the cable body 11 is extended to transmit electronic data for a greater distance.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A USB transmission cable structure, comprising:

a cable body, extending a length along an axial direction and forming an inner space, and the inner space forming an elliptical cross-section in a radial direction of the cable body perpendicular to the axial direction, a first quadrant, a second quadrant, a third quadrant, and a fourth quadrant being defined with a major axis and a minor axis of the elliptical cross-section;

a first high-frequency wire group arranged in the first quadrant and contacting the cable body;

a second high-frequency wire group arranged in the second quadrant and contacting the cable body;

a third high-frequency wire group arranged in the third quadrant and in contact with the cable body; and a fourth high-frequency wire group arranged in the fourth quadrant and in contact with the cable body;

wherein each of the high-frequency wire groups comprises:

two conductive wires, each having a conductor and an insulating layer covering the conductor, the conductive wires being arranged in contact with each other by the insulating layers;

a ground wire and a filler respectively arranged on two opposite sides of the contact between the two conductive wires and in contact with the insulating layers; and an insulating tape covering outer surfaces of the conductive wires and outer sides of the ground wire and the filler, the insulating tape having an inner layer and an outer layer, and the ground wire and the filler filling up a space formed between the conductive wires and the inner layer of the insulating tape to support and position the conductive wires.

2. The USB transmission cable structure according to claim 1, wherein the ratio of the major axis to the minor axis of the elliptic cross-section is in the range of 1.4:1 to 1.5:1.

3. The USB transmission cable structure according to claim 2, wherein the outer periphery of the cable body may be formed into an ellipse with the same shape as the inner periphery of the inner space.

4. The USB transmission cable structure according to claim 1, further comprising three main power wires arranged within a space surrounded by the first to fourth high-frequency wire groups along the major axis.

5. The USB transmission cable structure according to claim 4, further comprising:

a first ground wire disposed in a space between the first high-frequency wire group, the fourth high-frequency wire group and the cable body;

a second ground wire, arranged in a space between the second high-frequency wire group, the third high-frequency wire group and the cable body;

a third ground wire, arranged immediately adjacent to the main power wires and located in the first quadrant; and a fourth ground wire, arranged immediately adjacent to the main power wires and located in the second quadrant.

6. The USB transmission cable structure according to claim 5, further comprising differential signal data wires, arranged adjacent to the third ground wire and the fourth ground wire, and located in a space between the first high-frequency wire group and the second high-frequency wire group.

7. The USB transmission cable structure according to claim 6, further comprising a plurality of low-frequency wires, arranged adjacent to the main power wires, and in a space between the third high-frequency wire group and the fourth high-frequency wire group.

8. The USB transmission cable structure according to claim 7, further comprising:

a first support disposed in a space surrounded by the differential signal data wires, the first high-frequency wire group, the second high-frequency wire group, and the cable body; and a second support disposed in a space surrounded by the low-frequency wires, the third high-frequency wire group, the fourth high-frequency wire group, and the cable body;

wherein the cable body is supported by the first support and the second support so that the elliptical cross-section maintains a complete ellipse.

9. The USB transmission cable structure according to claim 8, wherein the first support or the second support is made of polyethylene (PE), thermoplastic elastomer (TPE), or polytetrafluoroethylene (PTFE).

* * * * *